US008281855B2

(12) United States Patent
Langlais et al.

(10) Patent No.: US 8,281,855 B2
(45) Date of Patent: Oct. 9, 2012

(54) SHROUDED TUBULAR

(75) Inventors: Michael D. Langlais, Houston, TX (US); Ezio Toffanin, Stavanger (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 363 days.

(21) Appl. No.: 12/554,896

(22) Filed: Sep. 5, 2009

(65) Prior Publication Data

US 2010/0059223 A1 Mar. 11, 2010

Related U.S. Application Data

(60) Provisional application No. 61/094,604, filed on Sep. 5, 2008.

(51) Int. Cl.
*E21B 43/08* (2006.01)

(52) U.S. Cl. ..... 166/236; 166/235

(58) Field of Classification Search ..... None
See application file for complete search history.

(56) References Cited

U.S. PATENT DOCUMENTS

| | | | | |
|---|---|---|---|---|
| 4,039,778 | A | 8/1977 | Williams | |
| 6,409,219 | B1 | 6/2002 | Broome et al. | |
| 2002/0189809 | A1 | 12/2002 | Nguyen et al. | |
| 2005/0200127 | A1 | 9/2005 | Johnson et al. | |
| 2007/0102153 | A1 * | 5/2007 | Bixenman et al. | 166/250.01 |
| 2010/0018697 | A1 * | 1/2010 | Richards et al. | 166/227 |
| 2010/0024889 | A1 * | 2/2010 | Walker et al. | 137/12 |
| 2010/0051262 | A1 * | 3/2010 | Dusterhoft et al. | 166/236 |
| 2010/0059232 | A1 | 3/2010 | Langlais et al. | |

* cited by examiner

*Primary Examiner* — Angela M DiTrani
(74) *Attorney, Agent, or Firm* — David G. Matthews; Rodney Warfford

(57) ABSTRACT

Systems and methods for a shrouded tubular device that includes but is not limited to a tubular member, such as a screen joint; a shroud surrounding at least a portion of the tubular, the shroud is at least a two-piece shroud; and a shim in the annulus between the tubular member and the shroud. By way of example only, the shroud may be located directly radially inward from the joint of two of the shroud pieces.

14 Claims, 3 Drawing Sheets

SHROUDED TUBULAR

REFERENCE TO RELATED APPLICATIONS

This application claims priority to U.S. Provisional Patent Application No. 61/094,604, filed on Sep. 5, 2008, incorporated herein by reference.

BACKGROUND

When well fluid is produced from a subterranean formation, the fluid typically contains particulates, or "sand." The production of sand from the well must be controlled in order to extend the life of the well. One technique to accomplish this involves routing the well fluid through a downhole filter formed from gravel that surrounds a sandscreen. More specifically, the sandscreen typically is a cylindrical mesh that is inserted into and is generally concentric with the borehole of the well where well fluid is produced. Gravel is packed in the annular area between the formation and the sandscreen. The well fluid being produced passes through the gravel, enters the sandscreen and is communicated uphole via tubing that is connected to the sandscreen.

The gravel that surrounds the sandscreen typically is introduced into the well via a gravel packing operation. In a conventional gravel packing operation, the gravel is communicated downhole via a slurry, which is a mixture of fluid and gravel. A gravel packing system in the well directs the slurry around the sandscreen so that when the fluid in the slurry disperses, gravel remains around the sandscreen.

In a conventional gravel packing operation, fluid may prematurely leave the slurry. When this occurs, a bridge forms in the slurry flow path, and this bridge forms a barrier that prevents slurry that is upstream of the bridge from being communicated downhole. Thus, the bridge disrupts and possibly prevents the application of gravel around some parts of the sandscreen.

For purposes of circumventing any possible bridges, a system for packing a well may include alternate path transport tubes, tubes that provide, as their names imply, alternative paths for communicating the slurry down into the well. In effect, the transport tubes serve as shunts in that should a bridge form, one of the transport tubes serves to bypass the bridge to permit slurry to be introduced into the well beyond the bridge. Examples are shown in U.S. Pat. No. 7,407,007, incorporated herein by reference.

It is typically desirable to protect the transport tubes and sand screens with a shroud to prevent damage while running in hole or during operation. Often, the shroud is installed as two separate pieces that may meet at or near the longitudinal center of the screen joint. Also present at or near the center of the screen joints is a bracket that is installed to secure the transport tubes. When installed, it may be necessary to have a clearance between the shroud and the screen. That clearance may preferably be about 0.20 inches. However, when these two pieces are installed consistent alignment of the two pieces is often difficult or impossible due to the play that exists between the outer diameter of the middle bracket and the inner diameter of the shrouds necessary to introduce the desired clearance.

It would be desirable to create a solution to cure or alleviate the play between the middle bracket and the shroud.

SUMMARY

Disclosed herein is a shrouded tubular device that includes but is not limited to a tubular member, such as a screen joint; a shroud surrounding at least a portion of the tubular, the shroud is at least a two-piece shroud; and a shim in the annulus between the tubular member and the shroud. By way of example only, the shroud may be located directly radially inward from the joint of two of the shroud pieces. Also disclosed herein is a method for making a shrouded tubular device.

DETAILED DESCRIPTION

Figure 1:
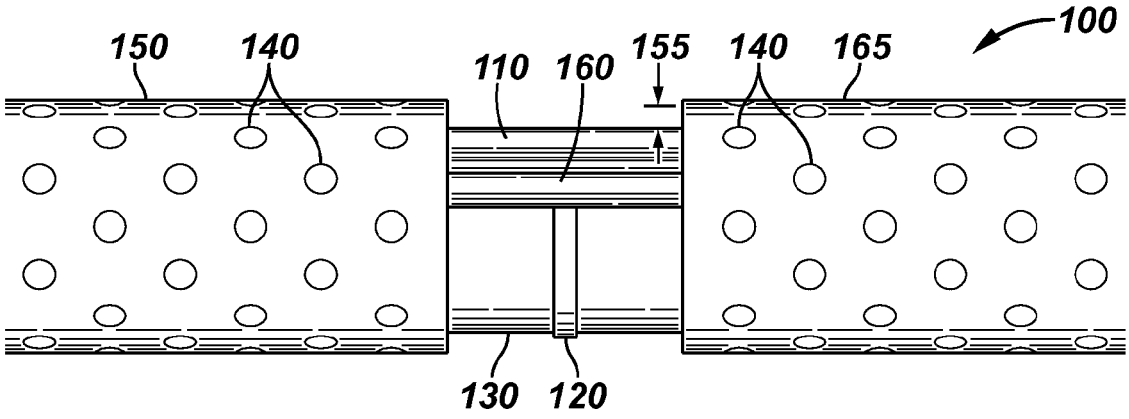
FIG. 1 is a schematic drawing of a two-piece shroud as is traditionally used.
Figure 2:
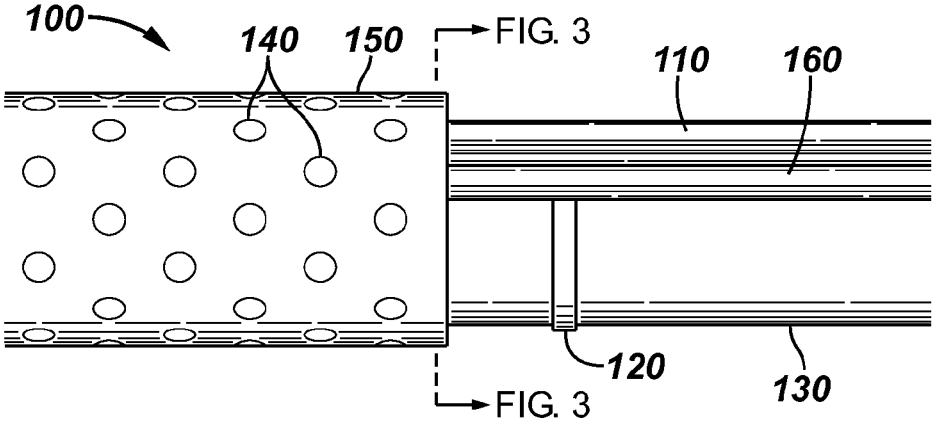
FIG. 2 is a schematic drawing of one piece of a traditional two-piece shroud.
Figure 3:
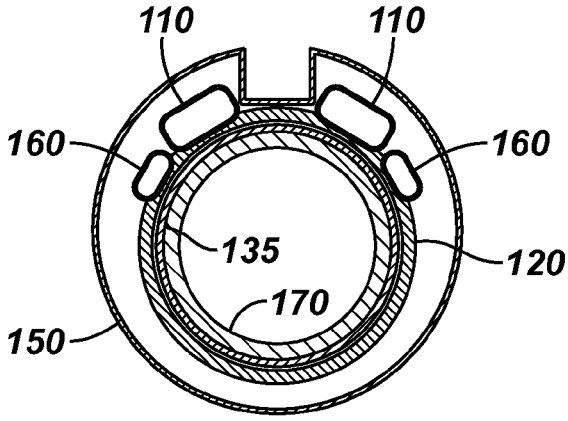
FIG. 3 is a cross section of a traditional shroud.
Figure 4:
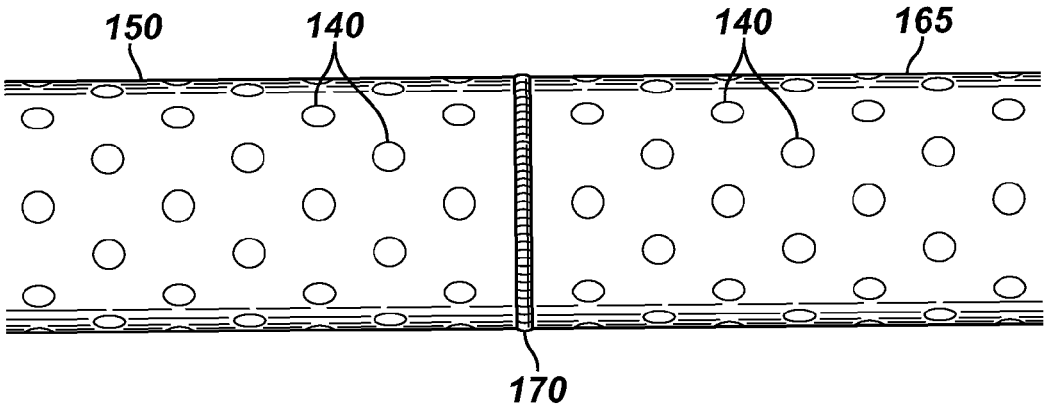
FIG. 4 is a schematic drawing of a welded traditional two-piece shroud.
Figure 5:
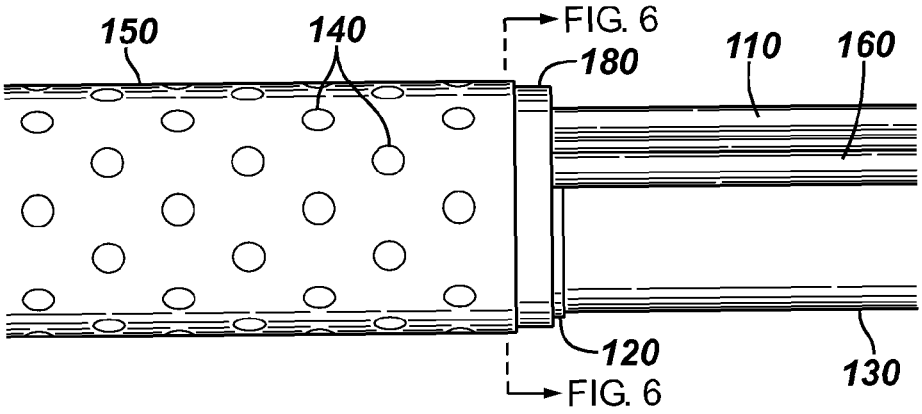
FIG. 5 is a schematic drawing of one piece of an embodiment of a two-piece shroud as is taught herein.
Figure 6:
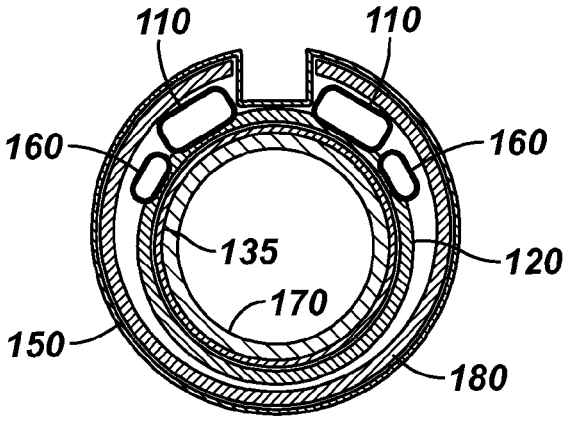
FIG. 6 is a schematic drawing of a cross section of an embodiment of a two-piece shroud as is taught herein.
Figure 7:
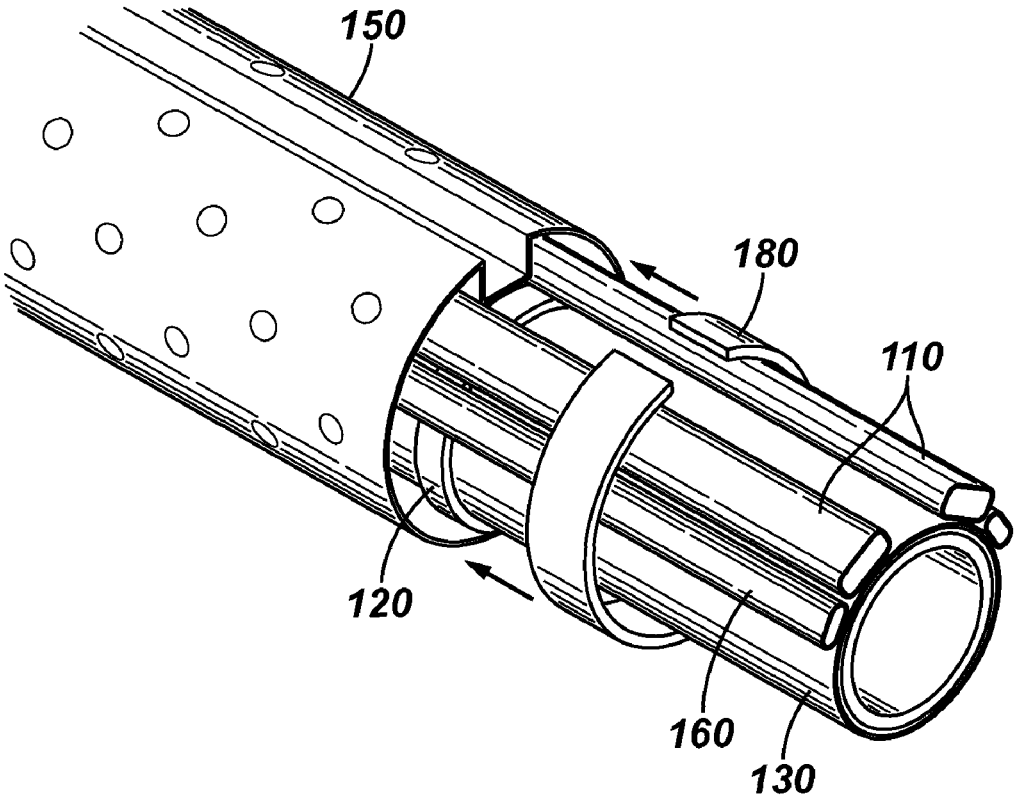
FIG. 7 is a schematic drawing of an embodiment of a two-piece shrouded tubular as is taught herein.
Figure 8:
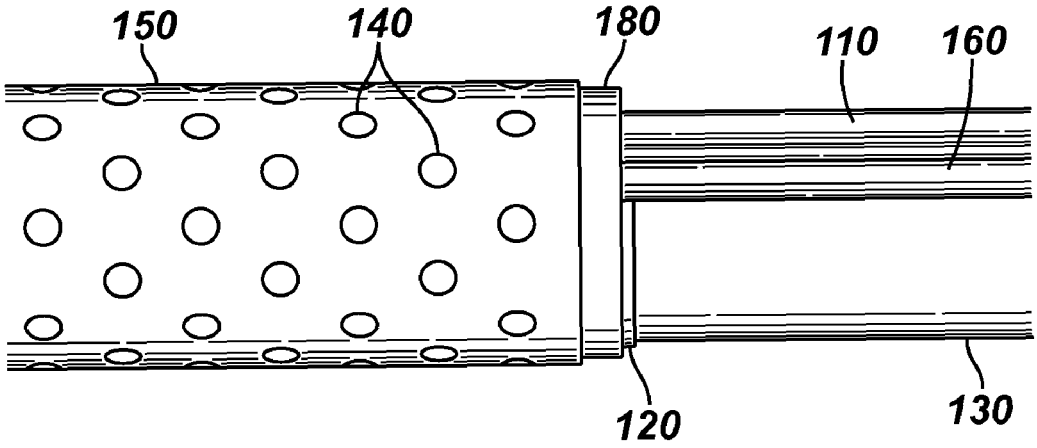
FIG. 8 is a schematic drawing of an embodiment of a two-piece shrouded tubular as is taught herein.

Referring now to FIG. 1, FIG. 2, FIG. 3, and FIG. 4 there is shown a schematic drawing of a traditional two-piece shrouded sand screen 100 having a first shroud member 150 and a second shroud member 165 being installed on opposite ends of the screen joint 130. Screen joint preferably comprises a screening element 135 (such as a wire wrapped screen) wrapped around perforated basepipe 170. Each of shrouds 150 and 165 are preferably perforated with perforations 140 which may be round or of any other acceptable shape. Also enclosed within the shrouds 150 and 165 and preferably outside of the screen joint 130 is at least one bypass or shunt tube 110. Also preferably enclosed within the shrouds 150 and 165 and external to the screen joint 130 is a leak-off tube 160. Preferably, optional bypass tube 110 and leak-off tube 160 run longitudinal to screen joint 130. However, it is possible that either or both of bypass tube 110 and leak-off tube 160 are spirally wound around screen joint 130 or otherwise arranged in a manner that the ends of the bypass tube 110 and optional leak-off tube 160 are preferably substantially coterminous with the shoulder of the screen joint (adjacent to the pin or box end).

During assembly, the traditional two-piece shrouded sand screen 100 is assembled by sliding the first and second shrouds 150 and 165 onto screen joint 130. When shrouds 150 and 165 meet to form the shroud joint (often directly radially outward from the bracket 120), they are welded as is shown by weld 170 in FIG. 4. Because of the clearance 155 needed between shrouds 150 and 165 and screen joint 130, it is often difficult to properly align shrouds 150 and 165 for welding. This can lead to welds, which make the circumferential profile of the shroud irregular. In some instances, it may be necessary to grind the welds to ensure the outer profile of the weld complies with the outer diameter of the other parts of the shroud. This introduces time and uncertainty in the manufacturing process as well as uncertainty into the strength of the welded joint.

In the embodiments as are shown in FIG. 5, FIG. 6, FIG. 7, and FIG. 8, similar elements as described above are similarly labeled. Particularly, in FIGS. 5-8 there is shown a schematic drawing of a two-piece shrouded sand screen 100 having a first shroud member 150 (second shroud member 165 is not shown, but is installed as is shown in FIG. 1) being installed on screen joint 130. Screen joint 130 preferably comprises a screening element 135 (such as a wire wrapped screen) wrapped around perforated basepipe 170. The shrouds (e.g., 150) are preferably perforated with perforations 140 which may be round or of any other acceptable shape. Also enclosed within the shrouds preferably outside of the screen joint 130 is at least one bypass or shunt tube 110. Also preferably enclosed within the shrouds and external to the screen joint 130 is a leak-off tube 160. Preferably, optional bypass tube 110 and leak-off tube 160 run longitudinal to screen joint 130. However, it is possible that either or both of bypass tube 110 and leak-off tube 160 are spirally wound around screen joint 130 or otherwise arranged in a manner that the ends of the bypass tube 110 and optional leak-off tube 160 are preferably substantially coterminous with the ends of the screen joint.

During assembly of the embodiments of FIGS. 5-8, the two-piece shrouded sand screen 100 may be assembled by sliding the first shroud 150 and second shroud (as shown in FIG. 1) onto screen joint 130. Also used is shim 180 that surrounds at least a portion of screen joint 130. Shim 180 may be sized and designed such that it takes up substantially all of the extra space or play in the annulus between the screen joint 130 and the shroud 150. When the shrouds are installed on the screen joint, the interface of the two parts of the shroud preferably meet directly radially outward from the shim 180. The shrouds may be welded to each other or welded to the shim or attached by any other acceptable means. Additionally, the shim may be attached to the bracket, e.g., by welding.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention. By way of example and not limitation, it is envisioned that the system described herein could be installed around a joint of sand screen—such as a wire wrapped perforated pipe or a wire mesh screen system—or around a piece of blank pipe. As used herein, the term preferably means that while one particular configuration may be desirable, other configurations are also possible. Also, as used herein, the term "tubular" does not necessarily connote a perfectly cylindrical device. By way of example only, as can be seen in the figures, it may be desirable to have a trough formed in the shroud.

The invention claimed is:

1. A shrouded tubular device comprising:

a tubular with a longitudinal axis, the tubular comprising a first tubular portion and a second tubular portion, wherein the first tubular portion and the second tubular portion are disposed along different sections of the longitudinal axis;

a shroud with perforations comprising a first tubular piece circumferentially surrounding the first tubular portion and a second tubular piece circumferentially surrounding the second tubular portion, the first tubular piece comprising an inner tubular piece end and an outer tubular piece end, the second tubular piece comprising an inner tubular piece end and an outer tubular piece end, wherein the inner tubular piece end of the first tubular piece is positioned adjacent the inner tubular piece end of the second tubular piece so that the first tubular piece and second tubular piece are positioned end-to-end at a junction along the longitudinal axis;

a sand screen between the tubular and the shroud;

at least one longitudinal bypass tube between the tubular and the shroud extending longitudinally along the first tubular portion and the second tubular portion; and a shim between the outer diameter of the tubular and the inner diameter of the shroud and disposed adjacent to the junction of the first tubular piece and the second tubular piece, the shim comprising a ring surrounding the tubular and radially disposed outward from the bypass tube, wherein the inner tubular piece ends of the first tubular piece and the second tubular piece of the shroud are disposed adjacent one another and surround at least a portion of the shim.

2. The device of claim 1 wherein the inner tubular piece ends of the first tubular piece and the second tubular piece are attached to the shim.

3. The device of claim 2 further comprising a bracket radially inward of the shim, wherein the bracket secures at least one longitudinal bypass tube.

4. The device of claim 2 wherein at least one of the first tubular piece and the second tubular piece are welded to the shim.

5. The device of claim 1 further comprising at least two longitudinal bypass tubes between the tubular and the shroud, and wherein the shim is a C-shaped ring.

6. The device of claim 1 wherein the inner tubular piece ends of the first tubular piece and the second tubular piece are attached to one another.

7. The device of claim 6 wherein the sand screen is a sand screen, and wherein the shroud has a channel with opposing walls extending inwardly from an outer surface of the shroud toward the tubular, and wherein the ring has opposing ring ends with a gap disposed between the ring ends and the opposing walls of the shroud extending into the gap between the ring ends.

8. A means for filtering particulates from a production fluid, the means comprising:

a tubular with a longitudinal axis, the tubular comprising a first tubular portion and a second tubular portion, wherein the first tubular portion and the second tubular portion are disposed along different sections of the longitudinal axis;

a shroud with perforations comprising a first tubular piece circumferentially surrounding the first tubular portion and a second tubular piece circumferentially surrounding the second tubular portion, the first tubular piece comprising an inner tubular piece end and an outer tubular piece end, the second tubular piece comprising an inner tubular piece end and an outer tubular piece end, wherein the inner tubular piece end of the first tubular piece is positioned adjacent the inner tubular piece end of the second tubular piece so that the first tubular piece and second tubular piece of the shroud are positioned end-to-end at a junction along the longitudinal axis; and a means for maintaining an annular space between the shroud and the tubular.

9. The means of claim 8 further comprising at least one longitudinal bypass tube between the tubular and the shroud.

10. The means of claim 9 further comprising a bracket radially inward of the shim, wherein the bracket secures the longitudinal bypass tube.

11. The means of claim 8 further comprising at least two longitudinal bypass tubes between the tubular and the shroud, and wherein the means for maintaining an annular space between the shroud and the tubular is sized to take up substantially all of the extra space between the tubular and the shroud.

12. The means of claim 8 further comprising a sand screen between the tubular and the shroud, and wherein the means for maintaining an annular space is a shim.

13. The means off claim 8 wherein the means for maintaining is a shim, wherein the shroud has a channel with opposing walls extending inwardly from an outer surface of the shroud toward the tubular, and wherein the shim comprises a ring with opposing ring ends with a cap disposed between the ring ends and the opposing walls of the shroud extending into the gap between the ring ends.

14. The means of claim 13 wherein at least one of the first tubular piece and the second tubular piece are welded to the shim.

* * * * *